US009212455B2

(12) United States Patent
Hunold et al.

(10) Patent No.: US 9,212,455 B2
(45) Date of Patent: Dec. 15, 2015

(54) COMBINATION OF A GUIDING PLATE AND A WEDGE ELEMENT AND SYSTEM FOR SECURING A RAIL FOR A RAIL VEHICLE TO A SUBSTRATE

(75) Inventors: André Hunold, Iserlohn (DE); Martin Gnaczynski, Plettenberg (DE)

(73) Assignee: Vossloh-Werke GmbH, Werdohl (DE)

( * ) Notice: Subject to any disclaimer, the term of this patent is extended or adjusted under 35 U.S.C. 154(b) by 271 days.

(21) Appl. No.: 13/988,888

(22) PCT Filed: Nov. 23, 2011

(86) PCT No.: PCT/EP2011/070810

§ 371 (c)(1),
(2), (4) Date: Jun. 11, 2013

(87) PCT Pub. No.: WO2012/069537

PCT Pub. Date: May 31, 2012

(65) Prior Publication Data

US 2013/0284820 A1 Oct. 31, 2013

(30) Foreign Application Priority Data

Nov. 23, 2010 (DE) ..... 10 2010 060 744

(51) Int. Cl.
*E01B 9/44* (2006.01)
*E01B 9/66* (2006.01)
*E01B 9/30* (2006.01)

(52) U.S. Cl.
CPC . *E01B 9/44* (2013.01); *E01B 9/303* (2013.01); *E01B 9/66* (2013.01)

(58) Field of Classification Search
CPC ..... E01B 9/303; E01B 9/483; E01B 9/30; E01B 9/60; E01B 9/28; E01B 9/66; E01B 9/34; E01B 9/306
USPC ..... 238/349, 351, 354, 333
See application file for complete search history.

(56) References Cited

U.S. PATENT DOCUMENTS

| | | | | |
|---|---|---|---|---|
| 2,579,373 | A * | 12/1951 | Edee | 238/346 |
| 3,986,667 | A | 10/1976 | Heim | |
| 5,221,044 | A * | 6/1993 | Guins | 238/349 |
| 2009/0308943 | A1 * | 12/2009 | Wirthwein et al. | 238/310 |
| 2011/0061229 | A1 | 3/2011 | Vorderbruck et al. | |

FOREIGN PATENT DOCUMENTS

| | | | |
|---|---|---|---|
| BE | 826013 | A1 | 6/1975 |
| CN | 101387090 | A | 3/2009 |
| CN | 202298372 | U | 7/2012 |

(Continued)

*Primary Examiner* — Mark Le
(74) *Attorney, Agent, or Firm* — The Webb Law Firm

(57) ABSTRACT

A combination of a guiding plate for laterally supporting a rail and a wedge element for adjusting the position of the rail relative to a counter-bearing, on which the guiding plate is supported. The guiding plate has an end face which is associated with the wedge element and which extends in the longitudinal direction and a lower side associated with a substrate. Between the guiding plate and the wedge element is a positive-locking guide along which the wedge element can be displaced in the longitudinal direction of the end face of the guiding plate. The guide between the wedge element may act as one joining partner and the guiding plate may act as another joining partner wherein, in one of the joining partners, there is formed a slot-like guide orientated along this joining partner and the projection of the other joining partner engages in a positive-locking manner.

12 Claims, 6 Drawing Sheets

(56) References Cited

FOREIGN PATENT DOCUMENTS

| | | | |
|---|---|---|---|
| DE | 10157676 | A1 | 6/2003 |
| DE | 202007018582 | U1 | 12/2008 |
| DE | 102007044098 | B3 | 4/2009 |
| EP | 2133467 | A1 | 12/2009 |
| WO | 2009103349 | A1 | 8/2009 |

* cited by examiner

COMBINATION OF A GUIDING PLATE AND A WEDGE ELEMENT AND SYSTEM FOR SECURING A RAIL FOR A RAIL VEHICLE TO A SUBSTRATE

BACKGROUND OF THE INVENTION

1. Field of the Invention

The invention relates to a combination of a guiding plate for laterally supporting a rail for a rail vehicle and a wedge element for adjusting the position of the rail relative to a counter-bearing, on which the guiding plate is supported in the assembly position, the guiding plate having an end face which is associated with the wedge element and which extends in the longitudinal direction of the rail to be supported and a lower side which is associated with a substrate which carries the guiding plate in an assembly position, the guiding plate and the wedge element being coupled to each other by means of a positive-locking connection which forms for the wedge element a guide in which the wedge element can be displaced in the longitudinal direction of the end face of the guiding plate.

The invention also relates to a system for securing a rail for a rail vehicle to a substrate, which comprises a combination of a guiding plate for laterally supporting the rail on a counter-bearing which is formed on the substrate and a wedge element for adjusting the position of the rail relative to the counter-bearing.

2. Description of Related Art

With the wedge element which is present in such a system, the spacing of the respective guiding plate relative to the support face can be determined. Owing to the wedge shape thereof, the adjustment element can be moved, from a position in which the spacing of the guiding plate and accordingly the rail from the respective support face is minimal, readily into a position in which a maximum spacing is provided. Between these extreme positions of the adjustment member, other adjustment positions can be selected which each determine a different spacing of the rail relative to the stop face and accordingly another track width.

A significant property of a system which is described, for example, in DE 101 57 676 A1 and which comprises a wedge element for adjusting the position of the guiding plate is that, after completed assembly, the connection between the guiding plate and the adjustment element is so secure that an unintentional relative movement of these two elements is prevented. To this end, in the known system, the abutment faces of the wedge element and guiding plate that are associated with each other have catch-like projections and recesses which are each orientated in an assembly position perpendicularly relative to the fixed substrate and engage one inside the other in such a manner that the wedge element is coupled to the guiding plate in a positive-locking manner by means of the projections and recesses which engage one inside the other. At the same time, it is ensured by the vertical orientation of the projections and recesses that the wedge element, even under the action of the longitudinal and transverse forces to which it is subjected during operation, retains its originally adjusted position.

For the possibility of being able to adjust the position of the respective guiding plate relative to the respective support face over a specific play, a complex assembly and disassembly of the entire system must be accepted in the prior art described above.

DE 10 2007 044 098 B3 describes a combination and a system of the type set out in the introduction, in which this disadvantage no longer exists. To this end, in this known combination of a guiding plate and wedge element, there are formed, on the faces at which the guiding plate and the wedge element are in mutual abutment in the assembly position, projections and recesses which engage in a positive-locking manner one inside the other, and which, when the wedge element is in the assembled state, extend parallel with the upper side of the level fixed substrate. The projections and recesses which are accordingly orientated in a horizontal manner in the assembly position enable the wedge element and guiding plate to be displaced with respect to each other, without the entire rail securing system having to be disassembled for this purpose. With the known combination, the wedge element can thus already be displaced after the clamping forces acting on the guiding plate have been released. Under the action of the clamping forces, however, the angled guiding plate applies to the wedge element a pressing force which is directed against the fixed substrate, as a result of which self-locking occurs in the region of the positive-locking connection between the guiding plate and wedge element. This effect can be reinforced by a plurality of projection/recess pairs being constructed on the mutually associated faces of the guiding plate and wedge element and by there being formed on the guiding plate a shoulder which presses on the wedge element in the completely assembled state.

The advantages achieved with the configuration described above are countered in practice by the disadvantage that the assembly is also comparatively difficult therein. For instance, the guiding plate must firstly be arranged on the respective substrate and the wedge element must subsequently be positioned on the guiding plate in a correctly fitting manner. The wedge element then rests loosely on the guiding plate until the rail is positioned, and the wedge element is retained between the rail base and the guiding plate. Under the rough conditions which are found in practice at the track construction site, owing to collision with the rail or another object, the wedge element repeatedly slides inadvertently and thus makes the positionally accurate orientation thereof more difficult. This is the case in particular when the assembly of the known system is intended to be carried out in a completely or partially automated manner.

SUMMARY OF THE INVENTION

Against this background, an object of the invention was to provide a combination of a guiding plate and wedge element which is in particular suitable for automatic assembly. Furthermore, a correspondingly constructed system for securing a rail was intended to be provided.

Advantageous embodiments of the invention are set out in the dependent claims and are explained in detail below as is the general notion of the invention.

A combination according to the invention comprises, as in the prior art set out in the introduction, a guiding plate for laterally supporting a rail for a rail vehicle and a wedge element for adjusting the position of the rail relative to a counter-bearing, on which the guiding plate is supported in the assembly position. In this instance, the guiding plate has an end face which is associated with the wedge element and which extends in the longitudinal direction of the rail to be supported and a lower side. This lower side is associated with a substrate, which carries the guiding plate in the assembly position. Typically, the relevant substrate is formed in practice by a sleeper or plate of concrete. Between the guiding plate and the wedge element, in a combination according to the invention, there is also provided a guide in the form of a positive-locking connection, along which the wedge element can be displaced in the longitudinal direction of the end face of the guiding plate.

According to the invention, the guide between the wedge element acting as the one joining partner and the guiding plate acting as the other joining partner is formed in that, in one of the mentioned joining partners, there is formed a slot-like guide which is orientated along this joining partner and in which a correspondingly formed projection of the other joining partner engages in a positive-locking manner in such a manner that the wedge element, when the projection is engaged, is secured in a direction orientated transversely relative to the longitudinal extent of the end face of the guiding plate and in the direction of the lower side of the guiding plate and, on the other hand, is secured to the guiding plate in a direction which is orientated perpendicularly relative to the end face of the guiding plate associated therewith.

According to the invention, the guide by means of which the wedge element and the guiding plate are connected to each other in a positive-locking manner is consequently constructed in such a manner that, when the positive-locking connection is produced, the guiding plate and the wedge element can be moved only in a maximum of two degrees of freedom, that is to say, in a longitudinal direction of the end face of the guiding plate which is associated with the wedge element, and in the direction of the upper side of the guiding plate. This enables the wedge element and the guiding plate to be already preassembled in a manner remote from the respective assembly location and then to be placed together at the assembly location in the correct orientation for the assembly. In this manner, the guiding plate/wedge element combinations can be preassembled in large batch numbers in a cost-effective manner and then be readily positioned, for example, by an automatically operating gripping device at the allocated assembly location. During the transport of the combinations from the location of the preassembly to the assembly location, with a correspondingly horizontal orientation of the guiding plate, the wedge element is also suspended securely on the guiding plate under the action of gravitational force, without separate securing of the retention of the wedge element on the guiding plate having to be carried out to that end. Consequently, the longitudinal displaceability is constantly maintained. As soon as the correspondingly assembled combination is placed at the assembly location, the wedge element can therefore be readily moved into the required position in order to provide an optimally orientated abutment face for the lateral support of the rail.

Consequently, with the invention, there is provided a combination comprising a guiding plate and a wedge element in which partially or fully automatic interruption-free assembly is enabled using conceivably simple means, without limitations with respect to the actual functionality of this combination having to be accepted to that end.

The shaping of the guide provided according to the invention is in principle not subjected to any limitations, as long as it is ensured that it is suitable to absorb the torque which acts in the region of the positive-locking connection between the guiding plate and wedge element as a result of the action of gravitational force or the inherent weight of the wedge element suspended on the guiding plate. As guides of this type, it is possible to use, for example, a laterally open T-shaped groove or the like which is formed in the one connection partner and in which a correspondingly adapted projection of the other connection partner engages. The preassembly of the combination is then carried out by the projection being pushed via the lateral opening into the guide. The advantage of a structure of the guide and projection which engages in the guide, which structure is T-shaped or the like in cross-section, is that, as a result of the webs which act at the upper and the lower side and which outwardly delimit the guide at the respective end face thereof, on the one hand, particularly secure support of the connection partner which is provided with the projection on the other connection partner during the transport from the preassembly to the assembly location and particularly precise guiding during the longitudinal displacement of the one connection partner relative to the other is ensured, which longitudinal displacement is subsequently carried out where applicable.

A further simplified preassembly with good retention at the same time may be achieved according to an embodiment in accordance with practice in that the guide is formed in the guiding plate and is constructed in the manner of a slot whose slot opening is orientated in the direction of the free upper side of the guiding plate opposite the lower side of the guiding plate. In this case, the wedge element can be hooked in the groove-like guide from above with the projection thereof which has a hook-like cross-section in this embodiment. The potentially complex introduction of the projection via a lateral opening of the guide may be dispensed with in this instance. Of course, with the same effect in principle, it is also conceivable to produce the slot-like guide in the wedge element and to form the projection on the guiding plate. However, it has been found to be advantageous in terms of handling for the larger guiding plate to be used as the retention member in which the wedge element is hooked.

The web which outwardly delimits the slot-like guide does not necessarily have to extend over the entire length of the guide. Instead, it may be sufficient for the relevant web to extend only over one or more portions of the length of the guide and for it to be ensured that a sufficiently large abutment face is provided on the web or webs for the projection which engages in the guide. Optimal retention and guiding during the longitudinal displacement are brought about in practice when the web extends over the entire length of the end face.

A precisely fitting retention and precise guiding of the wedge element on the guiding plate are achieved when the projection of the wedge element that engages in the slot-like guide which is formed on the guiding plate is constructed as a shoulder in which there is formed from the lower side of the wedge element associated with the substrate a slot which is delimited at the outer side thereof by a web, and when the width of the slot which is formed in the projection of the wedge element is adapted to the width of the web which delimits the slot-like guide of the guiding plate, with the exception of an oversize which is required for the displaceability of the wedge element on the guiding plate, or the width of the web which delimits the slot of the projection of the wedge element is adapted to the width of the slot-like guide of the guiding plate with the exception of an undersize which is required for the displaceability of the wedge element on the guiding plate.

If the guide is constructed as a slot which is open towards the upper side of the guiding plate or wedge element, owing to the fact that at least one stop is provided which, when the wedge element is connected to the guiding plate in a positive-locking manner, limits the relative movability of the wedge element and guiding plate in the direction of the upper side of the guiding plate, unintentional disengagement of the positive-locking connection between the guiding plate and wedge element can also be reliably prevented under the loads which occur during practical use. The stop is preferably constructed on the guiding plate owing to the larger space available at that location in order to allow the most stable configuration possible.

The positionally precise orientation of the guiding plate and wedge element relative to each other can be simplified by there being formed on the guiding plate and the wedge element mutually associated bearing faces which extend along and transversely relative to the mutually associated end faces of the guiding plate and wedge element and at which the guiding plate and wedge element touch each other in the state coupled to each other in a positive-locking manner. By there being constructed at the bearing faces mutually correspondingly formed marks which, when the guiding plate and wedge element are coupled to each other in a positive-locking manner, each releasably mark in a positive-locking manner a specific position of the wedge element with respect to the guiding plate, in a particularly simple manner specific positioning steps may further be predetermined in which the positioning of the guiding plate and wedge element relative to each other is carried out. The advantage of the arrangement of the marks on the bearing faces directed in the direction of the upper side or the lower side of the guiding plate or the wedge element is that, for a displacement of the guiding plate and the wedge element relative to each other, the positive-locking connection between the marks can be released by means of a slight lifting of one of the connection partners, without the guiding of the wedge element on the guiding plate being impaired thereby or a disassembly of the combination according to the invention having to be undertaken to a larger extent.

The assembly and adjustment of a system according to the invention can additionally be facilitated by there being provided on the guiding plate at least one stop projection which cooperates in a positive-locking manner with a recess of the wedge element in order to define a "0" position of the wedge element. Based on this "0" position, the correct orientation of the wedge element can then readily be carried out. Owing to the fact that the recess is delimited laterally by laterally flatly terminating webs, which are constructed in the manner of an inclined start member, it can, on the one hand, be ensured that the wedge element is retained reliably on the respective stop projection until a displacement which is carried out intentionally. On the other hand, it is also thus readily possible for the wedge element to be moved in a destruction-free manner with a slight application of force from the respective "0" position into the respective required position.

Protection against disengagement for the wedge element on the guiding plate can be produced in a simple manner by end stops being formed on the wedge element which, when a displacement end position of the wedge element has been reached, co-operate with the stop projections in a positive-locking manner.

BRIEF DESCRIPTION OF THE DRAWINGS

The invention is explained in greater detail below with reference to an embodiment. In the drawings.

DETAILED DESCRIPTION OF THE INVENTION

Figure 1:
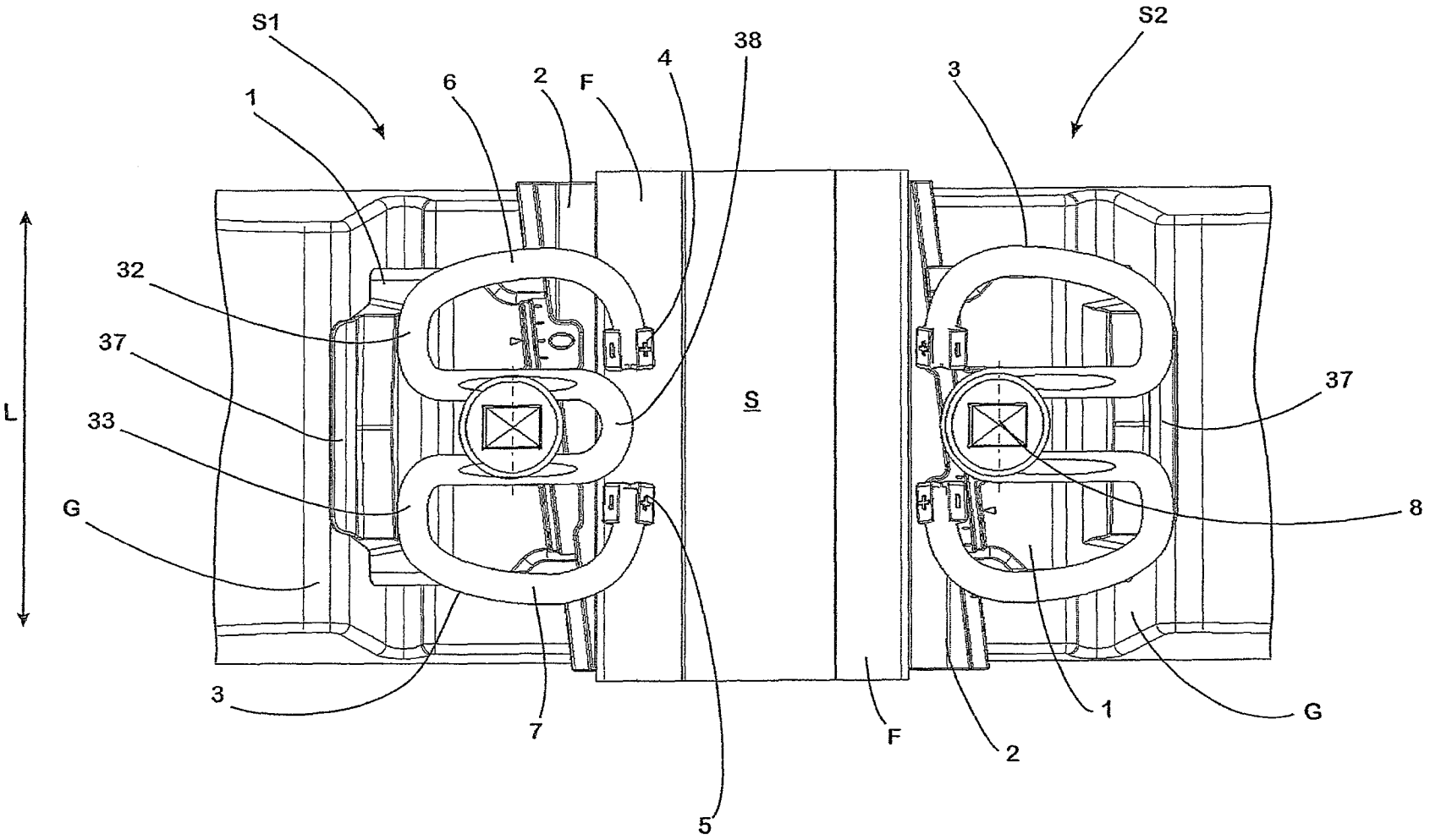
FIG. 1 is a view from above of a securing location for a rail.
Figure 2:
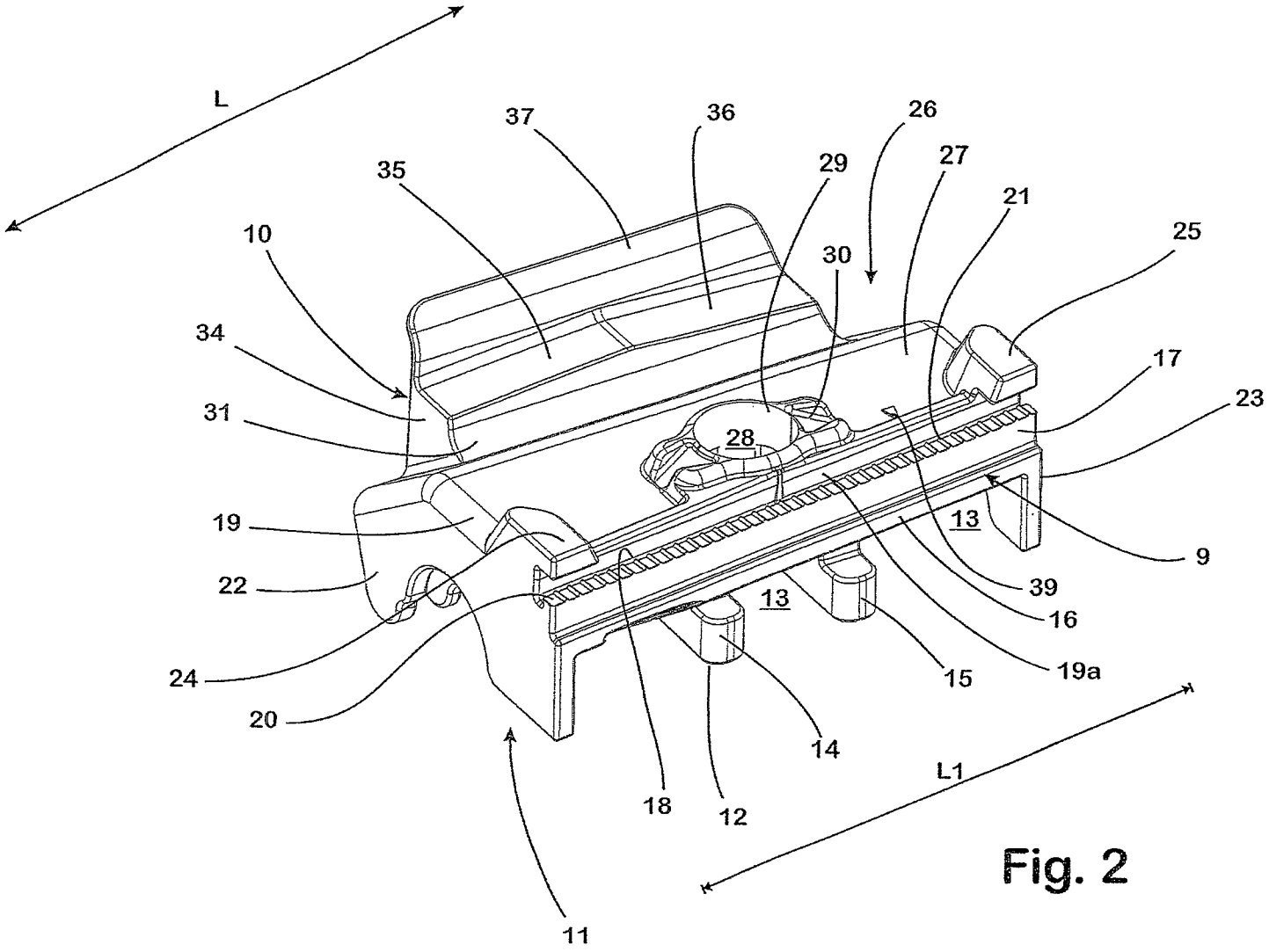
FIG. 2 is a perspective view of the guiding plate which is inserted at the securing location.
Figure 4:
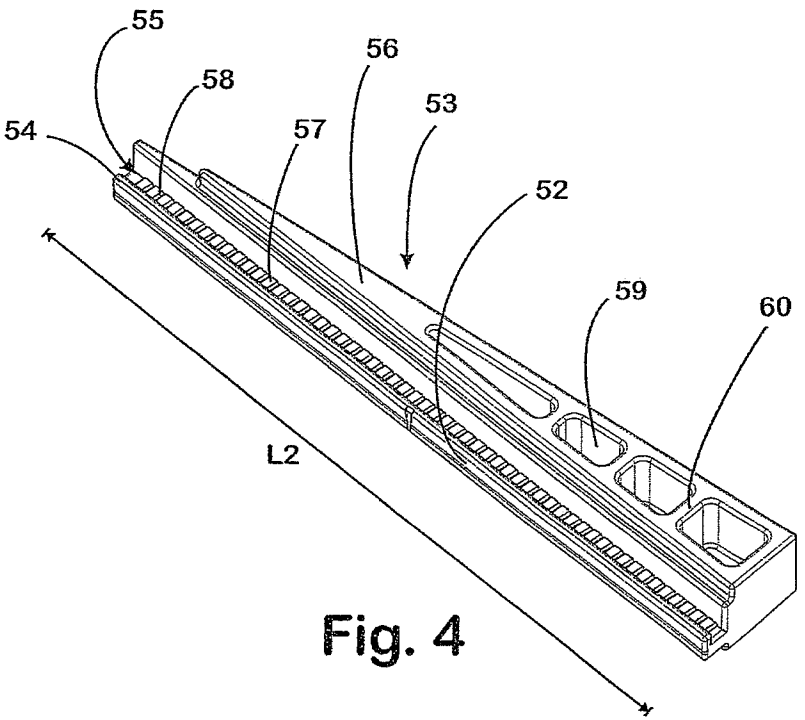
FIG. 4 is a perspective view from below of the wedge element according to FIG. 3.
Figure 3:
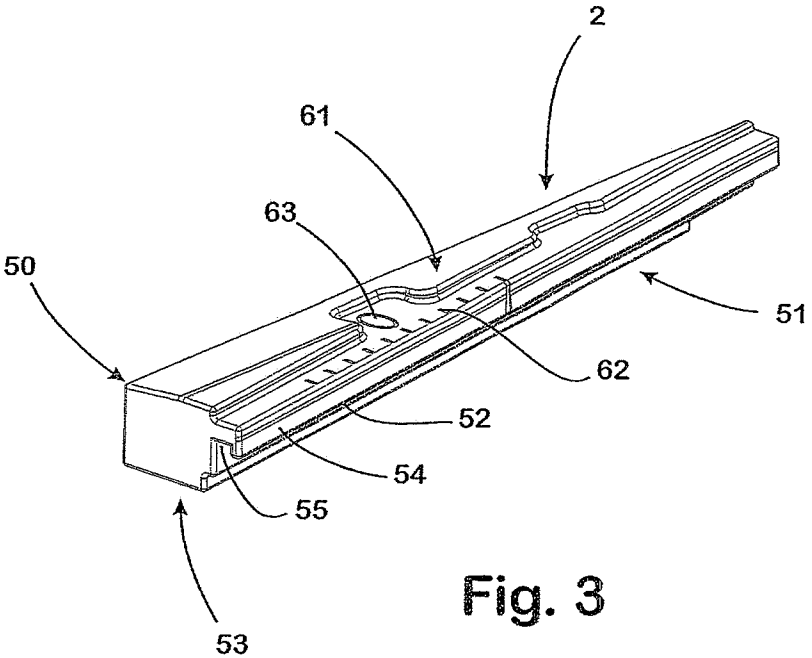
FIG. 3 is a perspective view from above of the wedge element which is inserted at the securing location.
Figure 5:
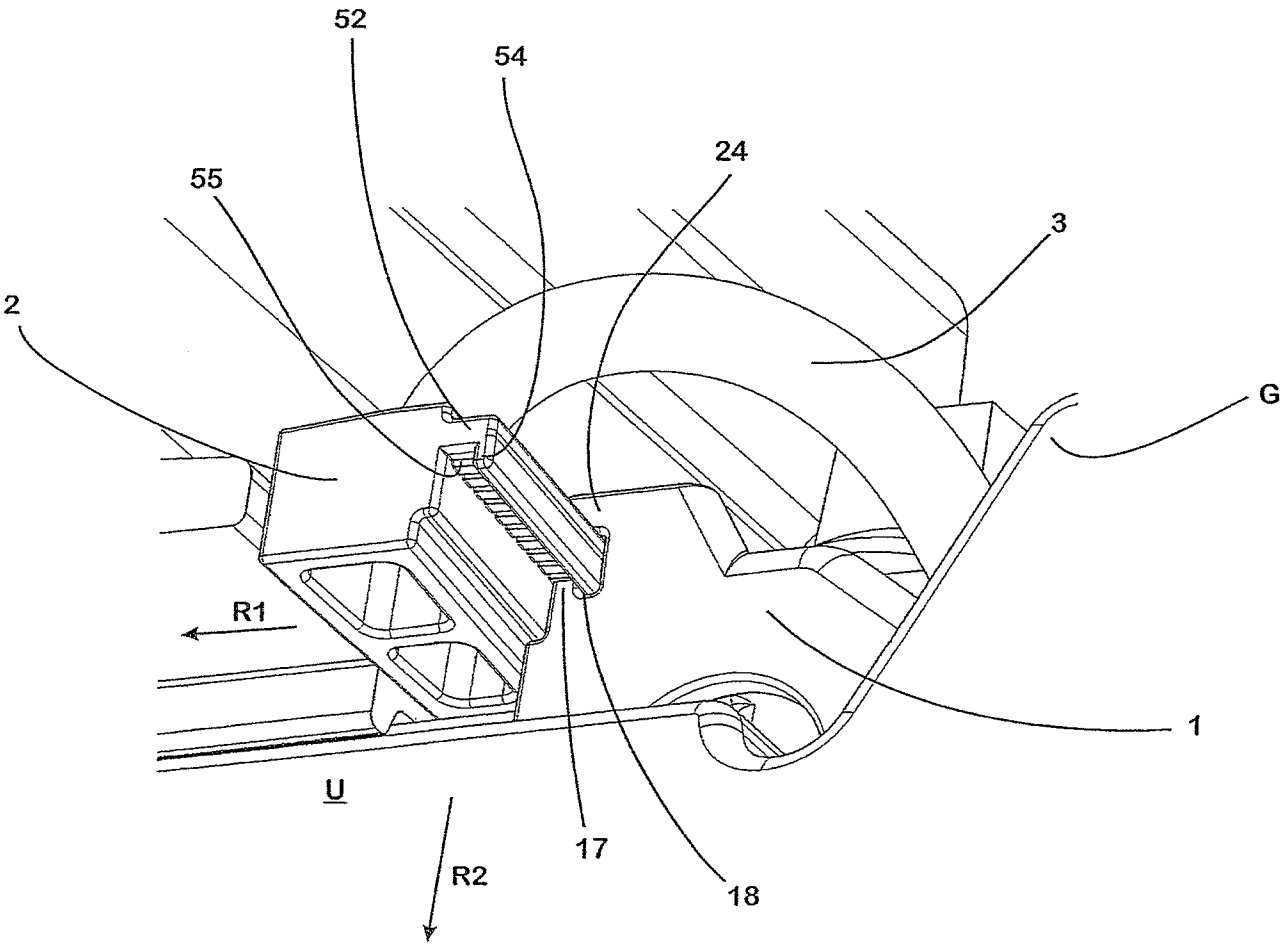
FIG. 5 is a perspective bottom view of a cutout of a combination formed from the guiding plate according to FIG. 2 and the wedge element according to FIGS. 3 and 4 in the assembly position.

The securing location shown in FIG. 1 comprises two systems S1, S2 which are constructed in an identical manner for securing a rail S to a substrate U which is formed by a sleeper of concrete. The one system S1 is positioned at one side and the other system S2 is positioned at the other side of the rail S to be secured. In FIG. 1, the system S1 which is associated with the left-hand longitudinal side of the rail S at that location is in the completely assembled position, whilst the system S2 which is associated with the right-hand longitudinal side of the rail S in FIG. 1 is preassembled.

Each of the systems S1, S2 comprises a guiding plate 1, a wedge element 2, a ω-shaped clamping clip 3, two adapter pieces 4, 5, of which one is arranged at one of the free ends of the retention arms 6, 7 of the clamping clips 3, respectively, and a clamping screw 8 for clamping the clamping clip 3 against the substrate U.

The guiding plate 1 which is produced integrally from a plastics material or another sufficiently strong material has the basic shape of a conventional angled guiding plate and has a first end face 9, which is associated with the rail base F of the rail S, and a second end face 10 which is formed at the side of the guiding plate 1 opposite the end face and by means of which the guiding plate 1 is supported in an assembly position (FIG. 1) on a counter-bearing G which is formed on the fixed substrate U in the form of a shoulder.

The first end face 9 is arranged in such an inclined manner with respect to the second end face 10 that the notional extensions thereof in the longitudinal direction L intersect at an acute angle.

At the lower side 11 of the guiding plate 1, a support face 12 is formed, by means of which the guiding plate 1 rests in the assembly position on the contact surface of the flat substrate U associated with the guiding plate 1. In the direction of the second end face 10, the contact surface 12 is delimited by a projection which extends over the length L1 of the guiding plate 1 and which in a manner known per se when the guiding plate is completely assembled rests in a correspondingly formed groove which cannot be seen here and which is arranged between the counter-bearing G and the contact surface of the substrate U.

Starting from the support face 12, in order to minimise the weight and the material expenditure required for production, there are formed in the guiding plate 1 recesses 13 which extend into the lower region of the first end face 9 which adjoins the lower side 11. The guiding plate 1 is reinforced in the manner of an arched construction in the region of the recesses 13, inter alia by ribs 14, 15 which are orientated transversely relative to the end faces 9, 10 so that, with minimised material requirement, optimal shaping rigidity is ensured.

Approximately at the central height of the first end face 9, there is formed on the first end face 9 a shoulder 16 which extends over the length L1 thereof and which upwardly delimits the openings of the recesses 13 associated with the end face 9.

In a state recessed by a specific small spacing with respect to the end face of the shoulder 16, there is additionally formed on the end face 9 a web 17 which also extends over the length L1.

The web 17 outwardly delimits a slot-like guide 18 which is formed in the end face 9 of the guiding plate 1 and which also extends over the entire length L1 of the guiding plate 1. The guide 18 is in the form of a laterally open groove having a substantially rectangular cross-section. In the direction of the second end face 10 of the guiding plate 1, the slot-like guide 18 is delimited by a wall 19*a* of a central shoulder 19 of the guiding plate 1.

At the free, upwardly directed upper side of the web 17, there is formed a bearing face 20 which is orientated parallel with the flat support face 12 and on which there are formed with regular spacings marks 21 in the form of catch webs which protrude with a small height above the bearing face 20 and in a state orientated transversely relative to the longitudinal direction L of the guiding plate 1.

In the region of the corners between the first end face 9 and the lateral walls 22, 23 of the guiding plate 1, a stop 24, 25 is formed in each case on the central shoulder 19. Each of the stops 24, 25 protrudes, on the one hand, over a specific height above the surface 27 of the central portion 19 provided at the upper side 26 of the guiding plate 1 and, on the other hand, protrudes in the direction of the first end face 9.

Starting from the surface 27, there is formed in the guiding plate 1 a through-opening 28 which leads to the lower side 11 and through which the clamping screw 8 is inserted in a manner known per se in order to clamp the clamping clip 3.

In order to optimise the electrical insulation, the through-opening 28 is surrounded at the surface 27 by a peripheral collar 29. This prevents fluid which accumulates on the surface 26 from reaching the through-opening 28 and forming at that location an electrically conductive bridge to the substrate U. At the same time, the peripheral collar 29 acts as a guide and support for the central loop 38 of the clamping clip 3 which is mounted on the guiding plate 1.

In order to prevent fluid from reaching the through-opening 28 via the clamping clip 3, inclined discharge members 29*a* are formed on the collar 28. These are formed so as to slope downwards in an inclined manner starting from the inner edge of the collar 29 in the direction of the walls 22, 23 so that water or other fluid, which reaches the guiding plate 1 from the clamping clip 3 at that location, is redirected laterally onto the surface 27 of the guiding plate 1. The surface 27 itself is also chamfered so as to slope slightly downwards in the direction of the second end face 10 so that fluid which reaches it can flow away in the direction of the second end face 10.

In the direction of the second end face 10, the surface 27 of the guiding plate 1 is delimited by a groove 31 which extends in the longitudinal direction L and in which, in a manner also known per se, the torsion portions 32, 33 of the clamping clip 3 rest in the completely assembled state. The base of the groove 31 which is open at the ends thereof associated with the walls 22, 23 may also be divided starting from the centre of the groove 31 into two inclined faces, one of which slopes downwards in the direction of the one wall 22 and the other in the direction of the other wall 23.

The groove 31 is adjoined in the direction of the second end wall 10 by a support shoulder 34. The surface thereof is also divided in the manner of the roof surface of a gable roof into two surface halves 35, 36, one of which slopes downwards in the direction of the one wall 22 and the other in the direction of the other wall 23. Accordingly, fluid which strikes the surface halves 35, 36 is also discharged laterally from the guiding plate 1.

In addition, the support shoulder 32 carries at the edge thereof associated with the end face 10 thereof an apron 37 which extends over the length L32 and which protrudes upwards over the surface halves 35, 36 and is formed in such a manner that, when the guiding plate 1 is completely assembled, it abuts the counter-bearing G in a planar manner with the outer face thereof associated with the second end face 10. Owing to the apron 37, the unavoidable joint gap between the counter-bearing G and the support shoulder 32 when the guiding plate 1 is fully assembled is covered in such a manner that no fluid can penetrate therein in particular from the surface halves 35, 36. The apron 37 thus forms an effective barrier against the penetration of fluid into the relevant joint gap or the porous material of the substrate U, which penetration is otherwise promoted by the capillary effect. In this manner, the apron 37 also contributes to the optimal insulation of the clamping clip 3 which generally comprises electrically conductive steel and consequently the rail S which also comprises electrically conductive steel with respect to the substrate U.

The wedge element 2 is also produced in an integral manner from plastics material or another sufficiently strong material. It has a wedge-like structure from above, having a first planar end face 50 which is associated with the rail base F and a second end face 51 which is associated with the guiding plate 1. The two end faces 50, 51 of the wedge element 2 extend in such an inclined manner towards each other that the notional extensions thereof in the longitudinal direction L intersect at the same angle as the notional extensions of the end faces 9, 10 of the guiding plate 1 in the longitudinal direction L. When the wedge element 2 is placed on the guiding plate 1, the first end face 50 of the wedge element 1 and the second end face 10 of the guiding plate 1 are accordingly orientated parallel with each other. The length L2 of the wedge element 2 is approximately double the length L1 of the guiding plate 1.

At the second end face 51 of the wedge element 2 associated with the guiding plate 1, there is formed a projection 52 which extends over the length L2. The projection 52 carries at the free end thereof a web 54 which is orientated in the direction of the lower side 53 of the wedge element 2 and which also extends over the length L2. The web 54 outwardly delimits a groove-like guiding slot 55 which is formed from the lower side 53 in the projection 52 and which is open in the direction towards the lower side 53 and the lateral ends thereof. The guiding slot 55 has a substantially rectangular cross-section and is delimited at the side thereof opposite the web 54 by the wall of a main body 56 of the wedge element 2. On the roof surface of the guiding slot 55 that forms a bearing face 57, marks 58 in the form of slot-like recesses are formed at regular intervals and are orientated transversely relative to the longitudinal extent of the guiding slot 55 and the web 54. The spacings between the marks 58 correspond to the spacings between the marks 21 which are formed on the bearing face 20 of the web 17 of the guiding plate 1. The shape and the dimensions of the marks 58 are also adapted to the shape and the dimensions of the marks 21.

From the lower side 53, in order to save material and to minimise the weight, there are formed in the wedge element 2 recesses 59 which are separated from each other by means of reinforcement ribs 60.

At the upper side 61 of the wedge element 2, spacing markings 62 are provided at the edge of the projection 52 associated with the guiding plate 1. There is associated with the spacing markings 62 on the guiding plate 1 a fixedly positioned arrow mark 39 which is arranged at the edge of the central portion 19 associated with the wedge element 2 so that, when the wedge element 2 abuts the guiding plate 1, it is possible, using the position of the spacing markings 62 with reference to the arrow mark 39, to read the position in which the wedge element 2 is located relative to the guiding plate 1.

In addition, starting from the upper side 61, a recess 63 is formed in the wedge element 2 at a central location. A tool for lifting the wedge element 2 can be introduced into the recess 63.

The clamping clip 3 which is conventionally formed in a ω-shaped manner has at the retention arms 6, 7 thereof an end portion which is cranked and which, when the system S1, S2 is completely assembled, is orientated substantially parallel with the rail S and applies the necessary retention force to the rail base F. On these end portions, an adapter piece 4, 5 is in each case rotatably supported about a rotation axis which coincides with the longitudinal axis of the relevant end portion.

When viewed from the end face, the adapter pieces 4, 5 are each in the form of a pentagon. On the peripheral face of the adapter pieces 4, 5 there are formed in each case three equally sized abutment face portions which are in direct mutual abutment and are separated from each other by an edge in each case. The two outer abutment face portions are additionally adjoined by two marking portions. These marking portions may be provided with identification markings which indicate the increase or decrease of the resilient tension which is linked with a rotation in the respective direction.

The marking portions are separated by a slot, which is formed from a radial direction in the adapter pieces 4, 5 and extends as far as a receiving member which is formed from the one end face thereof in the adapter pieces 4, 5. The slot intersects with a triangular opening in the base of the receiving member so that moisture or vapours which accumulate in the receiving member can be discharged from the respective adapter piece 4, 5 via the opening.

The centre point of the circular opening of the receiving member is arranged offset with respect to the centre point of the end faces of the adapter pieces 4, 5 in such a manner that the first abutment face portion has a first spacing z1, the second abutment face portion has a second spacing z2 and the third abutment face portion has a third spacing z3 with respect to the centre point of the receiving member, with $z1<z2<z3$. The spacings z1–z3 differ, for example, by one millimeter in each case.

The adapter pieces 4, 5 comprise an electrically non-conductive plastics material, which has, at least in its peripheral direction, a degree of resilience.

In the relaxed state, the receiving member of the adapter pieces 4, 5 has a diameter which is smaller by a small undersize than the end portions of the retention arms 6, 7 which are also circular in terms of diameter. When placed on the end portions, the adapter pieces are accordingly splayed in a peripheral direction so that, owing to the restoring forces then acting in the adapter pieces 4, 5, they are retained on the respectively associated end portion in a manner frictionally engaged but still rotatable with a given application of force. The splaying of the adapter pieces 4, 5 can be carried out in a simple manner owing to the slot, which in this manner not only prevents the accumulation of moisture in the respective adapter piece 4, 5 but additionally makes it easier to fit the adapter pieces 4, 5 on the respective end portion of the retention arms 6, 7 and ensures adequate resilient flexibility thereof.

The clearance between the stops 24, 25 and the marks 21 of the guiding plate 1 that are formed on the bearing face 20 is adapted to the thickness remaining between the bearing face 57 and the surface 62 of the wedge element 2 associated with the upper side 61 and the height of the web 54 in such a manner that, when the projection 52 is in engagement with the guide 18, the wedge element 2 can be lifted by a height which is sufficient to release the positive-locking connection between the marks 20 of the guiding plate 1 and the marks 58 of the wedge element 2 in order to carry out another longitudinal adjustment of the wedge element 2 relative to the guiding plate 1.

The width of the web 17 measured transversely relative to the longitudinal direction L and the guiding slot 55 and the width of the web 54 and the slot-like guide 18 also measured transversely relative to the longitudinal direction L are adapted to each other in such a manner that, when the projection 52 engages in a positive-locking manner with the web 54 thereof in the guide 18 and the web 17 engages in a positive-locking manner in the guiding slot 55, the wedge element 2 is displaceably guided with a small amount of play on the guiding plate 1 in the longitudinal direction L. At the same time, the positive-locking connection produced by the guide 18 and the projection 52 which engages therein secures the wedge element 2 on the guiding plate 1 in a direction R1 which is orientated perpendicularly relative to the first end face 9 of the guiding plate 1 or to the planar end face which is associated with the rail base F on the first end face 50 of the wedge element 2, and in a direction R2 which is directed in the direction of the lower side 11 of the guiding plate 1 and which is also orientated transversely relative to the longitudinal direction L.

The combination formed in this manner can be readily moved from a standby position to the assembly location in the preassembled state. The wedge element 2 is independently retained on the guiding plate 1 so that no additional measures for the correct positioning of the guiding plate 1 and wedge element 2 at the assembly location are required.

The systems S1, S2 are preassembled in the same manner. After the combination formed by the guiding plate 1 and wedge element 2 has been set down, the clamping clip 3 is placed to this end with the adapter pieces 4, 5 which are located thereon on the guiding plate 1 of the respective system S1, S2 in such a manner that the torsion portions 32, 33 thereof rest on the support portion 34 of the guiding plate 1. The adapter pieces 4, 5 are located in this preassembled state outside the space occupied by the rail base F after the rail S has been set down.

Subsequently, the clamping screw 8 of the respective system S1, S2 is inserted through the through-opening 28 of the guiding plate 1 into a plastics plug which is embedded in the substrate U and which cannot be seen in this instance and tightened until the clamping clip 3 is retained on the guiding plate 1 in the preassembly position thereof with a degree of pretensioning.

After the rail S has been positioned in the space delimited between the wedge elements 2 of the systems S1, S2, the clamping clips 3 are displaced in the direction of the rail S, until the end portions thereof rest with the adapter pieces 4, 5 on the rail base F and the torsion portions 32, 33 in the channel 31 of the respective guiding plate 1. Subsequently, if necessary, by means of corresponding longitudinal displacement of the wedge elements 2 relative to the respective guiding plate 1, the position of the rail S or the abutment face which is provided on the wedge elements 2 and which is associated with the rail base F can be adjusted in such a manner that optimal lateral support with correct orientation of the rail S is ensured.

If it is established that, owing to an excessively large or small height difference between the upper side of the rail base F and the upper side of the respective guiding plate 1, an insufficient or excessively large retention force is applied to the rail base F by a clamping clip 3, this can be compensated for by the adapter piece 4, 5 associated with the respective clamping clip being rotated about the respective rotation axis thereof in such a manner that it is supported on the rail base F by means of an abutment face portion with a smaller spacing (decrease of the retention force) or larger spacing (increase of the retention force) with respect to the rotation axis which then extends through the centre point of the receiving member. The adapter pieces 4, 5 thus enable a fine adjustment of the retention forces applied by the clamping clips 3 of the systems S1, S2. At the same time, they insulate the clamping clips 3 with respect to the rail S.

Figure 6:
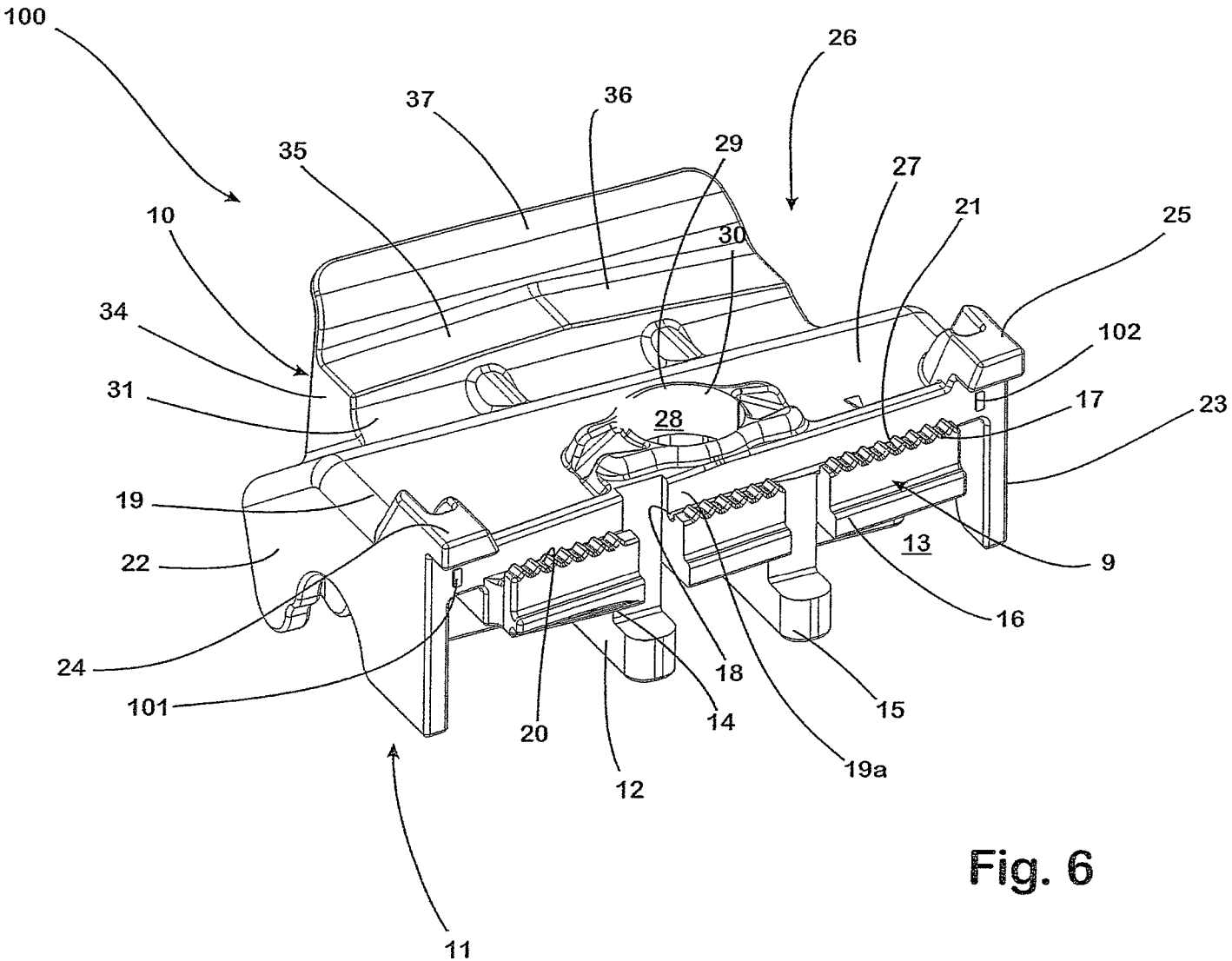
FIG. 6 is a perspective view of an alternative embodiment of a guiding plate which is inserted at the securing location.

In principle, the guiding plate 100 illustrated in FIG. 6 corresponds in terms of its basic structure and the features provided thereon to the guiding plate 1. Therefore, the features of the guiding plate 100 which correspond to the corresponding features of the guiding plate 1 are provided with the same reference numerals as in the guiding plate 1.

In a manner extending beyond the guiding plate 1, the guiding plate 100 has at the end-face wall 19*a* thereof that delimits the slot-like guide 18 in the region of the ends of the slot-like guide 18 a stop projection 101, 102 which protrudes from the wall 19*a* in each case. The stop projections 101, 102 may, as shown in this instance, be in the basic form of a parallelepiped having comparatively sharp edges between the free end face and the lateral faces thereof. One of the stop projections 101, 102 in each case is arranged in the region of the wall 19*a*, above which the stops 24, 25 protrude.

Figure 7:
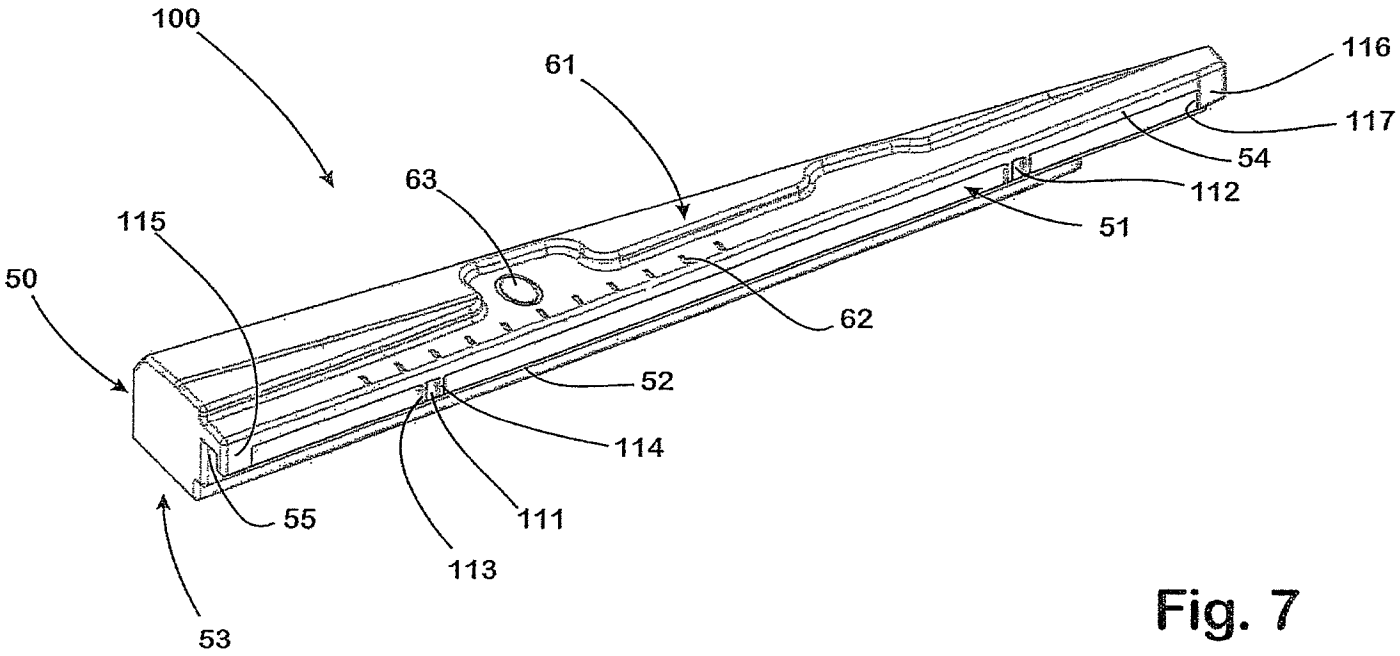
FIG. 7 is a perspective view from above of an alternative embodiment of a wedge element which is inserted at the securing location.

In principle, the wedge element 110 which is intended to co-operate with the guiding plate 100 and which is illustrated in FIG. 7 corresponds in terms of its basic structure and the features which are provided thereon to the wedge element 2. Therefore, the features of the wedge element 110, which correspond to the corresponding features of the wedge element 2 are provided with the same reference numerals as in the wedge element 2.

In addition, there are formed in the end face 51 of the wedge element 110 associated with the wall 19*a* of the guiding plate 100 in the assembled state with spacing relative to each other and with respect to the lateral ends of the end face 51 two recesses 111, 112 which are each delimited laterally by a web 113, 114. The spacing of the webs 113, 114 is selected in such a manner that the stop projections 101, 102, when one of the recesses 111, 112, by means of displacement of the wedge element 110 in the slot-like guide 18 of the guiding plate 100, is brought into alignment therewith, engage in the relevant recess 111, 112 in a positive-locking manner and with a small amount of play. The webs 113, 114 are formed in the manner of an inclined starting member so as to terminate in a laterally planar manner so that, taking into account the specific play which exists in the normal direction relative to the wall 19*a* and with which the wedge element 110 is guided in the guide 18, when the wedge element 110 is displaced, they can be pushed onto the respective stop projection 101, 102 when the wedge element 110 is displaced and the relevant stop projection 101, 102 can be overcome with a specific resistance. The stop projections 101, 102 thus constitute in cooperation with the recesses 111, 112 catch marks, by means of which two "0" positions are defined, starting from which the respective adjustment of the wedge element 110 can be carried out, for example, in order to compensate for occurrences of imprecision of assembly.

At the lateral ends of the end face 51 of the wedge element 110, there is provided in each case an end stop 115, 116 whose lateral face 117 which faces the other end stop 116, 115, respectively, is orientated substantially at right angles relative to the end surface of the end face 51 which is further constructed in a planar manner. If the end stops 115, 116, when the wedge element 110 is displaced in the guide 18 of the guiding plate 1, strike the associated stop projection 101, 102 in each case, the associated lateral face of the respective stop projection 101, 102 is in tight abutment against the relevant lateral face 117 of the respective end stop 115, 116. Since the lateral face 117 of the respective end stop 115, 116 and the lateral face of the respective stop projection 101, 102 which is then in abutment therewith are orientated parallel with each other and perpendicularly relative to the wall 19*a* or to the end surface of the end face 51, the end stops 115, 116, in contrast to the webs 113, 114, cannot overcome the stop projections 101, 102 without being destroyed. Together with the respective associated end stop 115, 116, the stop projections 101, 102 thus provide protection against the wedge element 110 unintentionally falling from the guide 18 of the guiding plate 100.

The invention claimed is:

1. A combination comprising:

a guiding plate for laterally supporting a rail for a rail vehicle and a wedge element for adjusting the position of the rail relative to a counter-bearing, wherein the guiding plate supports the wedge element at its vertical side facing the guiding plate, wherein the guiding plate comprises:

a vertical end face that is associated with the wedge element and that extends in a longitudinal direction of the rail to be supported and a lower side that is associated with a substrate, wherein the substrate carries the guiding plate in the assembly position, wherein a guide is provided between the vertical end face of the guiding plate and the vertical side of the wedge element via a positive-locking connection along which the wedge element can be displaced in the longitudinal direction of the end face of the guiding plate, wherein the guide between the wedge element acting as one joining partner and the guiding plate acting as another joining partner is formed such that, in one of the joining partners, a slotted guide is formed that is orientated along this joining partner and in the other joining partner there is formed a corresponding projection that engages in a positive-locking manner with the slotted guide such that the wedge element, when the projection is engaged with the slotted guide, is secured in a direction orientated transversely relative to the longitudinal direction of the end face of the guiding plate and in a direction perpendicular to the lower side of the guiding plate.

2. The combination according to claim 1, wherein the slotted guide is formed in the guiding plate and is constructed in the manner of a slot, whose slot opening is orientated in a direction of a free upper side of the guiding plate opposite the lower side of the guiding plate.

3. The combination according to claim 2, wherein a web that delimits the slotted guide in the longitudinal direction of the end face of the guiding plate associated with the wedge element extends over the entire length of the end face.

4. The combination according to claim 2, wherein the projection is formed on the wedge element that engages in the slotted guide and is constructed as a shoulder in which there is formed a slot which is delimited at an outer side thereof by a web, and wherein the width of the slot which is formed in the projection of the wedge element is adapted to the width of a web which delimits the slotted guide of the guiding plate, with an oversize that is provided for displaceability of the wedge element on the guiding plate, or wherein the width of the web which delimits the slot of the projection of the wedge element is adapted to the width of the slotted guide of the guiding plate with an undersize that is provided for displaceability of the wedge element on the guiding plate.

5. The combination according to claim 1, wherein there is provided at least one stop which, when the wedge element is connected in a positive-locking manner to the guiding plate, limits the relative movability of the wedge element and guiding plate in a direction of an upper side of the guiding plate.

6. The combination according to claim 5, wherein the stop is constructed on the guiding plate.

7. The combination according to claim 1, wherein there are formed on the guiding plate and the wedge element mutually associated bearing faces which extend along and transversely relative to the mutually associated end faces of the guiding plate and wedge element and at which the guiding plate and wedge element touch each other in the state coupled to each other in a positive-locking manner.

8. The combination according to claim 7, wherein there are formed on the bearing faces mutually correspondingly formed marks which, when the guiding plate and the wedge element are coupled to each other in the positive-locking manner, each identify a specific position of the wedge element with respect to the guiding plate.

9. A system for securing a rail for a rail vehicle to a substrate comprising a guiding plate for laterally supporting the rail on a counter-bearing which is formed on the substrate and a wedge element for adjusting the position of the rail relative to the counter-bearing, wherein the guiding plate and wedge element are constructed according to claim 1.

10. The system according to claim 9, wherein there is provided on the guiding plate at least one stop projection which cooperates in a positive-locking manner with a recess of the wedge element in order to define a "0" position of the wedge element.

11. The system according to claim 10, wherein the recess is delimited laterally by means of laterally flatly terminating webs that are inclined relative to the wedge element.

12. The system according to claim 10, wherein there are formed, on the wedge element, end stops that cooperate in a positive-locking manner with the stop projections when a displacement end position of the wedge element is reached.

* * * * *